US009563139B2

(12) United States Patent
Kawahara et al.

(10) Patent No.: US 9,563,139 B2
(45) Date of Patent: Feb. 7, 2017

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Masataka Kawahara, Mishima (JP); Masato Tanaka, Tagata-gun (JP); Jumpei Kuno, Mishima (JP); Tsutomu Nishida, Mishima (JP); Kaname Watariguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/878,208

(22) Filed: Oct. 8, 2015

(65) Prior Publication Data

US 2016/0124328 A1 May 5, 2016

(30) Foreign Application Priority Data

Nov. 5, 2014 (JP) ..... 2014-225221
Sep. 24, 2015 (JP) ..... 2015-187184

(51) Int. Cl.
*G03G 5/00* (2006.01)
*G03G 5/06* (2006.01)
*G03G 5/05* (2006.01)

(52) U.S. Cl.
CPC ..... *G03G 5/0696* (2013.01); *G03G 5/0564* (2013.01)

(58) Field of Classification Search
CPC ..... G03G 5/0696; G03G 5/0564
(Continued)

(56) References Cited

U.S. PATENT DOCUMENTS 5,834,149 A 11/1998 Tambo et al.
6,245,472 B1 6/2001 Tanaka
(Continued)

FOREIGN PATENT DOCUMENTS

JP 7-331107 A 12/1995
JP 3216426 B2 10/2001
(Continued)

OTHER PUBLICATIONS

U.S. Appl. No. 14/722,985, filed May 27, 2015. Inventor: Masataka Kawahara, et al.
(Continued)

*Primary Examiner* — Mark A Chapman
(74) *Attorney, Agent, or Firm* — Fitzpatrick, Cella, Harper & Scinto

(57) ABSTRACT

An electrophotographic photosensitive member wherein a charge generating layer of the electrophotographic photosensitive member includes a gallium phthalocyanine crystal in which an organic compound is contained, wherein the organic compound is at least one compound selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 2.0% by mass or less based on a gallium phthalocyanine in the gallium phthalocyanine crystal, and a charge transporting layer of the electrophotographic photosensitive member includes a polycarbonate resin having structural units represented by formulae (1) and (2).
(Continued)

(1)

(2)

11 Claims, 2 Drawing Sheets

(58) Field of Classification Search
USPC ..... 430/59.4, 59.6
See application file for complete search history.

(56) References Cited

U.S. PATENT DOCUMENTS

| | | | |
|---|---|---|---|
| 8,519,082 | B2 | 8/2013 | Hikosaka et al. |
| 8,808,953 | B2 | 8/2014 | Sugiura et al. |
| 2014/0170542 | A1 | 6/2014 | Tanaka |
| 2015/0316864 | A1 | 11/2015 | Kuno et al. |
| 2015/0346616 | A1 | 12/2015 | Kawahara et al. |

FOREIGN PATENT DOCUMENTS

| | | | |
|---|---|---|---|
| JP | 2011-26574 | A | 2/2011 |
| JP | 2013-200417 | A | 10/2013 |
| JP | 2014-134773 | A | 7/2014 |

OTHER PUBLICATIONS

U.S. Appl. No. 14/936,545, filed Nov. 9, 2015. Inventor: Masataka Kawahara, et al.
U.S. Appl. No. 14/928,769, filed Oct. 30, 2015. Inventor: Masato Tanaka, et al.
U.S. Appl. No. 14/943,830, filed Nov. 17, 2015. Inventor: Hirofumi Kumoi, et al.
U.S. Appl. No. 14/927,300, filed Oct. 29, 2015. Inventor: Hirofumi Kumoi, et al.

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus including the electrophotographic photosensitive member.

Description of the Related Art

Currently, an electrophotographic photosensitive member is generally a functional separation type laminated photosensitive member in which a charge-generating function (charge generating layer) and a charge-transporting function (charge transporting layer) are shared in respective separate layers.

With respect to a charge-generating substance having the charge-generating function, the emission wavelength of a semiconductor laser commonly used as an image exposing unit is as long as from 650 to 820 nm, and therefore a charge-generating substance having a high sensitivity to light of a long wavelength is developed in progress.

A phthalocyanine pigment is effective as such a charge-generating substance having a high sensitivity to light up to a long wavelength region, and in particular, oxytitanium phthalocyanine and gallium phthalocyanine, having excellent sensitive characteristics, have been heretofore reported with respect to various crystal forms and improved production methods.

Japanese Patent Application Laid-Open No. H07-331107 discloses a hydroxygallium phthalocyanine crystal containing a polar organic solvent. N,N-dimethylformamide is used for a conversion solvent to thereby allow the polar organic solvent to be incorporated in the crystal, providing a crystal having excellent sensitive characteristics.

On the other hand, the charge transporting layer sharing the charge transporting function is demanded to have mechanical strength and less degradation of discharge because of having the charge transporting function and being located on the outermost surface of the electrophotographic photosensitive member. Accordingly, a charge transporting material having high mobility and a resin having a strong mechanical strength and having resistance to discharge are developed in progress.

In particular, a problem is that the charge transporting layer is made thinner due to abrading in repeated use of the photosensitive member, to thereby result in an increase in electric field strength to cause fogging (a phenomenon where a toner is slightly developed in a region in which the toner is not to be essentially developed).

Japanese Patent Application Laid-Open No. 2011-026574 describes a polycarbonate copolymer excellent in wear resistance, and provides a photosensitive member excellent in wear resistance.

SUMMARY OF THE INVENTION

As described above, various improvements have been tried with respect to the electrophotographic photosensitive member. The photosensitive member described in Japanese Patent Application Laid-Open No. H07-331107, however, has the following problem: a photocarrier produced easily remains in a photosensitive layer and such a remaining photocarrier easily causes image defects such as fogging and a black spot.

Then, fogging has been demanded to be further prevented from the viewpoints of response to a higher image quality and suppression of the amount of a toner to be consumed, in recent years.

The present invention is directed to providing an electrophotographic photosensitive member that can have an improved charge generating material in a charge generating layer of a functional separation type laminated photosensitive member and an improved charge transporting layer thereof to thereby allow a high-quality image, in which fogging is sufficiently suppressed, to be output even if the charge transporting layer is made thinner by repeated use of the photosensitive member.

Further, the present invention is directed to providing an electrophotographic apparatus and a process cartridge including the electrophotographic photosensitive member.

According to one aspect of the present invention, there is provided an electrophotographic photosensitive member including a support, and a charge generating layer and a charge transporting layer on the support, wherein the charge generating layer includes a gallium phthalocyanine crystal in which an organic compound is contained, wherein the organic compound is at least one compound selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 2.0% by mass or less based on a gallium phthalocyanine in the gallium phthalocyanine crystal, and the charge transporting layer includes a polycarbonate resin having structural units represented by the following formulae (1) and (2):

(1)

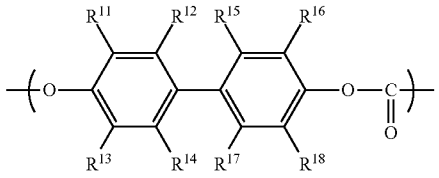

(2)

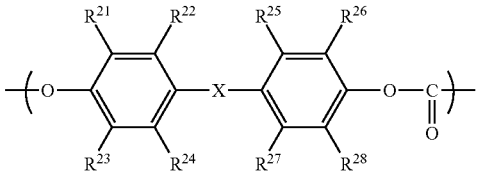

wherein $R^{11}$ to $R^{18}$ in the formula (1) and $R^{21}$ to $R^{28}$ in the formula (2) each independently represent a hydrogen atom, an alkyl group, an aryl group, a halogen atom or an alkoxy group; and X in the formula (2) represents any of

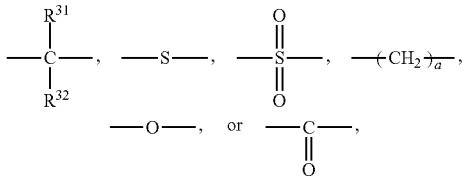

wherein $R^{31}$ and $R^{32}$ represent any selected from the group consisting of a hydrogen atom, a halogen atom, a substituted or unsubstituted alkyl group, a substituted or unsubstituted aryl group, a substituted or unsubstituted alkenyl group, and a group required to form a carbocyclic ring or a heterocyclic ring by bonding of $R^{31}$ and $R^{32}$, and a represents an integer of 1 to 20.

According to another aspect of the present invention, there is provided a process cartridge detachably attachable to a main body of an electrophotographic apparatus, wherein the process cartridge integrally supports the electrophotographic photosensitive member and at least one unit selected from the group consisting of a charging unit, a developing unit and a cleaning unit.

According to further aspect of the present invention, there is provided an electrophotographic apparatus including the electrophotographic photosensitive member, and a charging unit, an exposing unit, a developing unit and a transferring unit.

The present invention can provide an electrophotographic photosensitive member that can allow a high-quality image, in which fogging is sufficiently suppressed, to be output, as well as a process cartridge and an electrophotographic apparatus including the electrophotographic photosensitive member.

Further features of the present invention will become apparent from the following description of exemplary embodiments with reference to the attached drawings.

DESCRIPTION OF THE EMBODIMENTS

Figure 1:
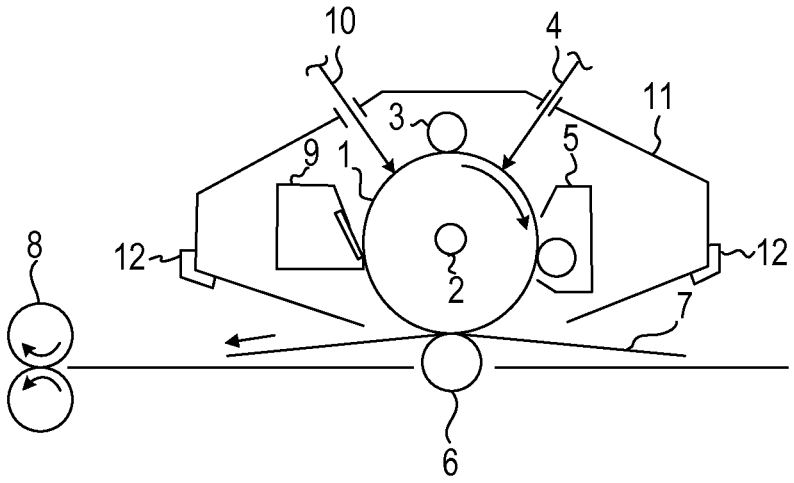
FIG. 1 is a view illustrating one example of a schematic configuration of an electrophotographic apparatus provided with a process cartridge including the electrophotographic photosensitive member of the present invention.

Preferred embodiments of the present invention will now be described in detail in accordance with the accompanying drawings.

As described above, the electrophotographic photosensitive member of the present invention includes a support, and a charge generating layer and a charge transporting layer on the support.

The charge generating layer includes a gallium phthalocyanine crystal in which an organic compound is contained, and the organic compound is at least one compound selected from the group consisting of dimethylsulfoxide, N,N-dimethylformamide, N-methylformamide, N-propylformamide, N-vinylformamide and N-methylpyrrolidone. Then, the content of the organic compound is 0.1% by mass or more and 2.0% by mass or less based on a gallium phthalocyanine in the gallium phthalocyanine crystal.

Furthermore, the charge transporting layer includes a polycarbonate resin having structural units represented by the following formulae (1) and (2):

(1)

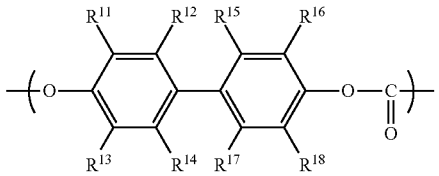

(2)

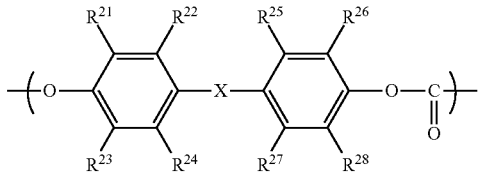

wherein $R^{11}$ to $R^{18}$ in the formula (1) and $R^{21}$ to $R^{28}$ in the formula (2) each independently represent a hydrogen atom, an alkyl group, an aryl group, a halogen atom or an alkoxy group. X in the formula (2) represents any of

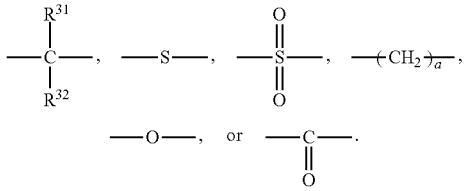

Here, $R^{31}$ and $R^{32}$ each independently represent a hydrogen atom, a halogen atom, a substituted or unsubstituted alkyl group, a substituted or unsubstituted aryl group, a substituted or unsubstituted alkenyl group, or a group required to form a carbocyclic ring or a heterocyclic ring by bonding of $R^{31}$ and $R^{32}$, and a represents an integer of 1 to 20. The substituents of the substituted alkyl group, the substituted aryl group and the substituted alkenyl group include a halogen atom, an alkyl group or an aryl group. The carbocyclic ring and the heterocyclic ring formed by bonding of $R^{31}$ and $R^{32}$ include a fluorene structure and an adamantane structure.

The structural unit represented by the formula (2) is preferably a structural unit represented by any of the following formulae (4) to (7).

(4)

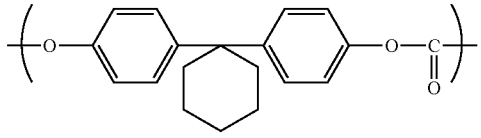

(5)

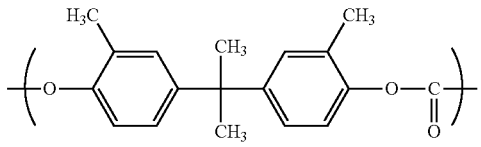

-continued (6)

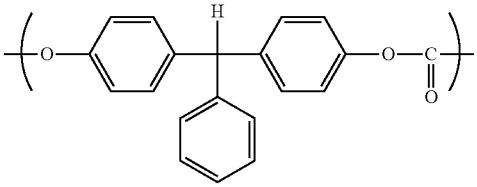

(7)

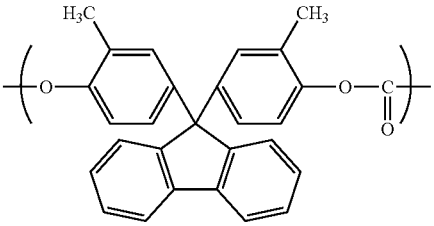

The polycarbonate resin having the structural units represented by the formulae (1) and (2) is obtained by reacting a bisphenol represented by the following formulae (8) and (9):

(8)

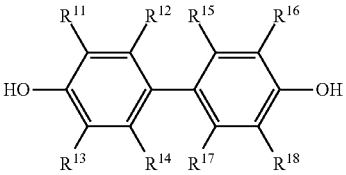

(9)

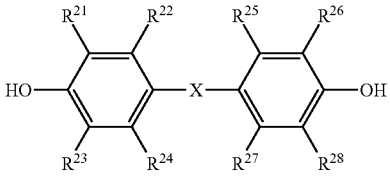

($R^{11}$ to $R^{18}$ in the formula (8) and $R^{21}$ to $R^{28}$ in the formula (9) have the same meanings as in the formulae (1) and (2), respectively) with phosgene, carbonate or chloroformate.

Examples of the bisphenol represented by the formula (8) can include the following, but the present invention is not limited to the following:

4,4'-dihydroxybiphenyl,
4,4'-dihydroxy-3,3'-dimethylbiphenyl,
4,4'-dihydroxy-2,2'-dimethylbiphenyl,
4,4'-dihydroxy-3,3',5-trimethylbiphenyl,
4,4'-dihydroxy-3,3',5,5'-tetramethylbiphenyl,
4,4'-dihydroxy-3,3'-dibutylbiphenyl,
4,4'-dihydroxy-3,3'-dicyclohexylbiphenyl,
3,3'-difluoro-4,4'-dihydroxybiphenyl, and
4,4'-dihydroxy-3,3'-diphenylbiphenyl.

Examples of the bisphenol compound represented by the formula (9) include bis(4-hydroxyphenyl)methane,
bis(3-methyl-4-hydroxyphenyl)methane,
bis(3-chloro-4-hydroxyphenyl)methane,
bis(3,5-dibromo-4-hydroxyphenyl)methane,
bis(4-hydroxyphenyl)ether,
bis(3-methyl-4-hydroxyphenyl)ether,
bis(3-fluoro-4-hydroxyphenyl)ether,
bis(4-hydroxyphenyl)sulfone,
bis(3-methyl-4-hydroxyphenyl)sulfone,
bis(4-hydroxyphenyl)sulfoxide,
bis(3-methyl-4-hydroxyphenyl)sulfoxide,
bis(4-hydroxyphenyl)sulfide,
bis(3-methyl-4-hydroxyphenyl)sulfide,
bis(4-hydroxyphenyl)ketone,
bis(3-methyl-4-hydroxyphenyl)ketone,
1,1-bis(4-hydroxyphenyl)ethane,
1,1-bis(3-methyl-4-hydroxyphenyl)ethane,
1,1-bis(3-fluoro-4-hydroxyphenyl)ethane,
1,1-bis(2-tert-butyl-4-hydroxy-3-methylphenyl)ethane, 1,2-bis(4-hydroxyphenyl)ethane,
1,2-bis(3-methyl-4-hydroxyphenyl)ethane,
2,2-bis(4-hydroxyphenyl)propane,
2,2-bis(3-methyl-4-hydroxyphenyl)propane,
2,2-bis(3-cyclohexyl-4-hydroxyphenyl)propane,
2,2-bis(3-phenyl-4-hydroxyphenyl)propane,
2,2-bis(3,5-dimethyl-4-hydroxyphenyl)propane,
2,2-bis(3-fluoro-4-hydroxyphenyl)propane,
2,2-bis(3-chloro-4-hydroxyphenyl)propane,
2,2-bis(3-bromo-4-hydroxyphenyl)propane,
2,2-bis(3,5-difluoro-4-hydroxyphenyl)propane,
2,2-bis(3,5-dichloro-4-hydroxyphenyl)propane,
2,2-bis(3,5-dibromo-4-hydroxyphenyl)propane,
2,2-bis(2-tert-butyl-4-hydroxy-3-methylphenyl)propane,
2,2-bis(4-hydroxyphenyl)hexafluoropropane,
2,2-bis(3-methyl-4-hydroxyphenyl)hexafluoropropane,
2,2-bis(3,5-dimethyl-4-hydroxyphenyl)hexafluoropropane,
2,2-bis(3-phenyl-4-hydroxyphenyl)hexafluoropropane,
2,2-bis(3-fluoro-4-hydroxyphenyl)hexafluoropropane,
2,2-bis(3-chloro-4-hydroxyphenyl)hexafluoropropane,
2,2-bis(4-hydroxyphenyl)butane,
2,2-bis(3-methyl-4-hydroxyphenyl)butane,
2,2-bis(3,5-dimethyl-4-hydroxyphenyl)butane,
2,2-bis(3-fluoro-4-hydroxyphenyl)butane,
2,2-bis(3-chloro-4-hydroxyphenyl)butane,
2,2-bis(3-bromo-4-hydroxyphenyl)butane,
2,2-bis(3,5-difluoro-4-hydroxyphenyl)butane,
2,2-bis(3,5-dichloro-4-hydroxyphenyl)butane,
2,2-bis(3,5-dibromo-4-hydroxyphenyl)butane,
2,2-bis(2-tert-butyl-4-hydroxy-3-methylphenyl)butane, 1,1-bis(4-hydroxyphenyl)cyclohexane,
1,1-bis(3-methyl-4-hydroxyphenyl)cyclohexane,
1,1-bis(3-cyclo-4-hydroxyphenyl)cyclohexane,
1,1-bis(3-phenyl-4-hydroxyphenyl)cyclohexane,
1,1-bis(3,5-dimethyl-4-hydroxyphenyl)cyclohexane,
1,1-bis(3-fluoro-4-hydroxyphenyl)cyclohexane,
1,1-bis(3-chloro-4-hydroxyphenyl)cyclohexane,
1,1-bis(3-bromo-4-hydroxyphenyl)cyclohexane,
1,1-bis(3,5-difluoro-4-hydroxyphenyl)cyclohexane,
1,1-bis(3,5-dichloro-4-hydroxyphenyl)cyclohexane,
1,1-bis(3,5-dibromo-4-hydroxyphenyl)cyclohexane,
1,1-bis(2-tert-butyl-4-hydroxy-3-methylphenyl)cyclohexane,
2,2-bis(4-hydroxyphenyl)adamantane
and
1,3-bis(4-hydroxyphenyl)adamantane,
and the above can also be used in combinations of two or more.

The limiting viscosity of the polycarbonate resin for use in the present invention is preferably 0.3 to 2.0 dl/g.

A terminal stopping agent or a molecular weight modifier is usually used in the polycarbonate resin for use in the present invention, and examples thereof include a compound having a monohydric phenolic hydroxyl group. Examples include, in addition to usual phenol, p-tert-butylphenol and tribromophenol, a long chain alkyl phenol, an aliphatic carboxylic acid chloride, an aliphatic carboxylic acid, a hydroxybenzoic acid alkyl ester, a hydroxyphenylalkyl acid ester and an alkyl ether phenol.

The amount of the terminal stopping agent or the molecular weight modifier to be used is 100 to 0.2 mol and can be 50 to 2 mol based on 100 mol of all the bisphenol to be used, and two or more compounds can also be, of course, used in combination.

A branching agent can be further used in combination in the range from 0.01 to 3% by mol, particularly 0.1 to 1.0% by mol relative to the bisphenol type compound, to provide a branched polycarbonate resin. The branching agent include polyhydroxy compounds such as phloroglucin, 2,6-dimethyl-2,4,6-tri(hydroxyphenyl)heptene-3,4,6-dimethyl-2,4,6-tri(4-hydroxyphenyl)heptene-2,1,3,5-tri(2-hydroxyphenyl)benzol, 1,1,1-tri(4-hydroxyphenyl)ethane, 2,6-bis(2-hydroxy-5-methylbenzyl)-4-methylphenol and α,α',α"-tri(4-hydroxyphenyl)1,3,5-triisopropylbenzene, as well as 3,3-bis(4-hydroxyaryl)oxyindol, 5-chloroisatin and 5,7-dichloroisatin, and 5-bromoisatin.

Specific examples of the polycarbonate resin having the structural units represented by the formulae (1) and (2) are shown below, but the present invention is not limited to the following. The ratio of the structural units means the molar ratio.

Exemplary compound 1

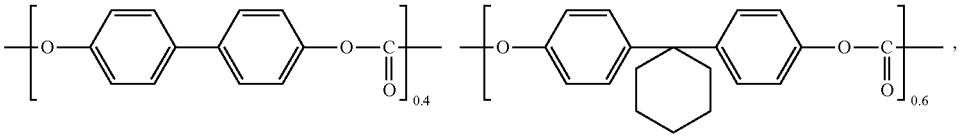

Exemplary compound 2

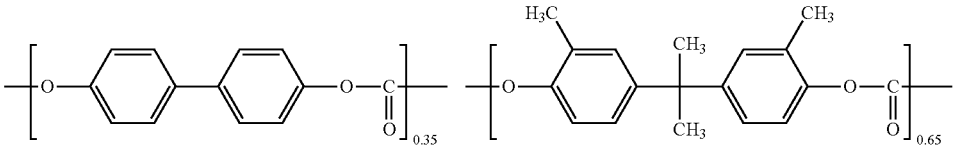

Exemplary compound 3

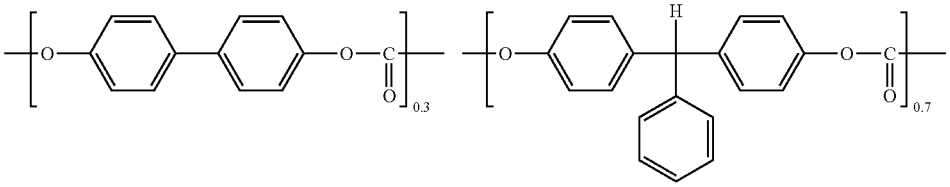

Exemplary compound 4

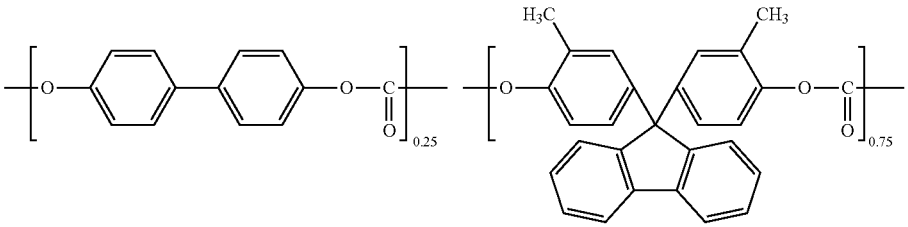

Exemplary compound 5

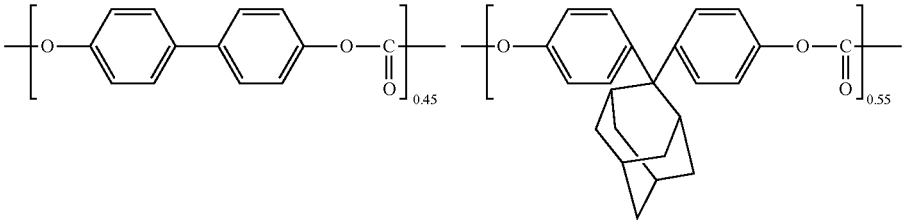

Exemplary compound 6

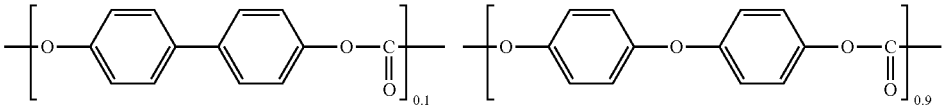

Exemplary compound 7

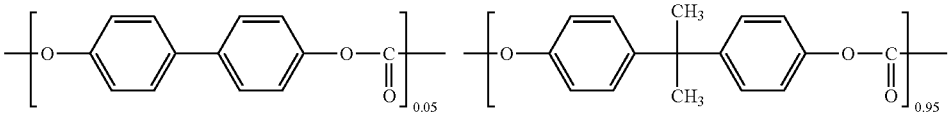

The organic compound contained in the gallium phthalocyanine crystal in the present invention may be of a plurality of organic compounds, and the content is 0.1% by mass or more and 2.0% by mass or less in total based on the gallium phthalocyanine in the gallium phthalocyanine crystal.

The content of the organic compound is preferably 0.1% by mass or more and 1.9% by mass or less based on the gallium phthalocyanine in the gallium phthalocyanine crystal.

The content of the organic compound is more preferably 0.3% by mass or more and 1.5% by mass or less based on the gallium phthalocyanine in the gallium phthalocyanine crystal.

The organic compound can be N-methylformamide, N-propylformamide or N-vinylformamide.

As the gallium phthalocyanine crystal, a hydroxygallium phthalocyanine crystal, a chlorogallium phthalocyanine crystal, a bromogallium phthalocyanine crystal and an iodogallium phthalocyanine crystal having an excellent sensitivity can act effectively in the present invention and are preferably. In particular, the gallium phthalocyanine crystal is particularly preferably a hydroxygallium phthalocyanine crystal or a chlorogallium phthalocyanine crystal. The hydroxygallium phthalocyanine crystal has a hydroxy group as an axial ligand to a gallium atom. The bromogallium phthalocyanine crystal has a bromine atom as an axial ligand to a gallium atom. The iodogallium phthalocyanine crystal has an iodine atom as an axial ligand to a gallium atom.

The hydroxygallium phthalocyanine crystal is more preferably a hydroxygallium phthalocyanine crystal having peaks at Bragg angles 2θ of 7.4°±0.3° and 28.3°±0.3° in CuKα characteristic X-ray diffraction, in terms of high sensitivity.

The chlorogallium phthalocyanine crystal is more preferably a chlorogallium phthalocyanine crystal having peaks at Bragg angles 2θ±0.2° of 7.4°, 16.6°, 25.5° and 28.3° in CuKα characteristic X-ray diffraction in terms of high sensitivity.

The method for producing the gallium phthalocyanine crystal in which the organic compound is contained is described.

The gallium phthalocyanine crystal in which the organic compound is contained, in the present invention, is obtained in a step of adding the gallium phthalocyanine to a solvent including the organic compound and subjecting the resultant to a wet milling treatment to thereby perform crystal transformation of the gallium phthalocyanine. The gallium phthalocyanine crystal is obtained by the milling treatment using the solvent including organic compound. The gallium phthalocyanine for use in the wet milling treatment can be a gallium phthalocyanine obtained by an acid pasting method or a dry milling treatment.

The wet milling treatment here conducted is, for example, a treatment conducted using a milling apparatus such as a sand mill or a ball mill together with a dispersant such as glass beads, steel beads or an alumina ball. The wet milling time can be about 30 to 3000 hours. In particular, a method can be adopted in which a sample is taken every 10 to 100 hours, and the content of the organic compound in the gallium phthalocyanine crystal is confirmed by NMR measurement. The amount of the dispersant for use in the wet milling treatment can be 10 to 50 times the amount of the gallium phthalocyanine on a mass basis.

The amount of the organic compound to be used can be 5 to 30 times the amount of the gallium phthalocyanine crystal on a mass basis.

Whether the gallium phthalocyanine crystal in the present invention contains the organic compound in the crystal or not is determined in the present invention by subjecting the resulting gallium phthalocyanine crystal to NMR measurement.

X-ray diffraction and NMR measurements of the gallium phthalocyanine crystal contained in the electrophotographic photosensitive member of the present invention are performed under the following conditions.

(Powder X-Ray Diffraction Measurement)

Measurement machine used: X-ray diffraction apparatus RINT-TTRII manufactured by Rigaku Corporation
X-ray tube bulb: Cu
Tube voltage: 50 KV
Tube current: 300 mA
Scanning method: 2θ/θ scanning
Scanning speed: 4.0°/min
Sampling interval: 0.02°
Start angle (2θ): 5.0°
Stop angle (2θ): 40.0°
Attachment: standard specimen holder
Filter: not used
Incident monochromator: used
Counter monochromator: not used
Divergence slit: open
Vertical divergence limitation slit: 10.00 mm
Scattering slit: open
Light-receiving slit: open
Flat plate monochromator: used
Counter: scintillation counter (NMR Measurement)

Measurement instrument used: AVANCEIII 500 manufactured by Bruker Corporation
Solvent: deuterosulfuric acid ($D_2SO_4$)

The photosensitive layer in the present invention is a laminated photosensitive member obtained by laminating the charge generating layer including the gallium phthalocyanine crystal in which the organic compound is contained, and the charge transporting layer including the polycarbonate resin having the structural units represented by the formulae (1) and (2). A lamination relationship between the charge generating layer and the charge transporting layer is as follows: the charge generating layer corresponds to an underlayer.

The support for use in the present invention can be one having electro-conductivity (electro-conductive support). Examples include metals and alloys such as aluminum and stainless steel, or metals, alloys, plastics and paper provided with the electro-conductive layer. The shape of the support includes a cylindrical shape or a film shape.

In the present invention, an undercoat layer (also referred to as "intermediate layer") having a barrier function and an adhesion function can also be provided between the support and the photosensitive layer.

For the material of the undercoat layer, polyvinyl alcohol, polyethylene oxide, ethyl cellulose, methyl cellulose, casein, polyamide, glue, gelatin and the like are used. The undercoat layer can be formed by coating the support with a coating liquid for an undercoat layer, containing the above material, to form a coating film, and drying the coating film. A metal oxide may also be added as a resistance control agent.

The thickness of the undercoat layer can be 0.3 to 5.0 μm.

Furthermore, an electro-conductive layer for the purposes of covering of irregularities and defects of the support and prevention of interference fringes can be provided between the support and the undercoat layer.

The electro-conductive layer can be formed by dispersing an electro-conductive particle such as carbon black, a metal particle and a metal oxide in a binder resin.

The thickness of the electro-conductive layer is preferably 5 to 40 μm, particularly preferably 10 to 30 μm.

The charge generating layer can be formed by coating of a coating liquid for a charge generating layer, the coating liquid being prepared by dispersing the gallium phthalocyanine crystal, in which the organic compound is contained, and the binder resin in a solvent, and drying of the resulting coating film.

The thickness of the charge generating layer is preferably 0.05 to 1 μm, more preferably 0.1 to 0.3 μm.

The content of the gallium phthalocyanine crystal containing the organic compound, in the charge generating layer, is preferably 40% by mass or more and 85% by mass or less, more preferably 60% by mass or more and 80% by mass or less based on the total mass of the charge generating layer.

Examples of the binder resin for use in the charge generating layer include resins such as polyester, an acrylic resin, polycarbonate, polyvinyl butyral, polystyrene, polyvinyl acetate, polysulfone, an acrylonitrile copolymer and polyvinyl benzal. In particular, polyvinyl butyral or polyvinyl benzal can be adopted in terms of dispersibility of the gallium phthalocyanine crystal.

The charge transporting layer can be formed by coating of a coating liquid for a charge transporting layer, in which the charge transporting material and the polycarbonate resin having the structural units represented by the formulae (1) and (2) are dissolved in a solvent, and drying of the resulting coating film. In addition, a release agent for the purpose of an increase in transfer efficiency of a toner, a fingerprint adhesion inhibitor for the purpose of prevention of contamination and the like, a filler for the purpose of prevention of abrading, and a lubricant for the purpose of an increase in lubricating property on the drum surface may also be added to the charge transporting layer.

For the solvent for use in preparation of the charge transporting layer of the electrophotographic photosensitive member according to the present invention, ketone type solvents such as acetone and methyl ethyl ketone, ester type solvents such as methyl acetate and ethyl acetate;

aromatic hydrocarbon solvents such as toluene, xylene and chlorobenzene;

ether type solvents such as 1,4-dioxane and tetrahydrofuran;

hydrocarbon solvents such as chloroform substituted with a halogen atom;

and the like are used. Such solvents may be used singly or as a mixture of two or more. Among such solvents, a solvent having a dipole moment of 1.0 D or less is preferable, and xylene and methylal (dimethoxymethane) are more preferable.

In formation of the charge transporting layer, such a solvent is used in combination with the polycarbonate resin having the structural units represented by the formulae (1) and (2), and the charge transporting material to thereby provide an electrophotographic photosensitive member that is excellent in coatability and that hardly causes fogging even in repeated use.

The thickness of the charge transporting layer is preferably 5 to 40 μm, particularly preferably 7 to 25 μm.

The content of the charge-transporting substance is preferably 20 to 80% by mass, particularly preferably 30 to 60% by mass based on the total mass of the charge transporting layer.

The charge-transporting substance includes various triarylamine compounds, hydrazone compounds, stilbene compounds, pyrazoline compounds, oxazole compounds, thiazole compounds and triallylmethane compounds. In particular, a triarylamine compound can be adopted as the charge-transporting substance.

For the coating method of each of the layers, a coating method such as a dip-coating method (dipping method), a spray coating method, a spinner coating method, a bead coating method, a blade coating method and a beam coating method can be used.

FIG. 1 is a view illustrating one example of a schematic configuration of an electrophotographic apparatus provided with a process cartridge including the electrophotographic photosensitive member of the present invention.

The symbol 1 is a cylindrical (drum-shaped) electrophotographic photosensitive member, is rotatably driven at a predetermined peripheral speed (process speed) about a shaft 2 in the arrow direction.

The surface of the electrophotographic photosensitive member 1 is charged to a predetermined positive or negative potential by a charging unit 3 in the course of rotation. Next, the surface charged of the electrophotographic photosensitive member 1 is irradiated with image exposing light 4 from an image exposing unit (not illustrated), and an electrostatic latent image is formed according to image information intended. The image exposing light 4 is light intensity-modulated according to a time-series electric digital image signal of image information intended, the light being output from an image exposing unit such as a slit exposing unit or a laser beam scanning exposure unit.

The electrostatic latent image formed on the surface of the electrophotographic photosensitive member 1 is developed (regularly developed or reversely developed) by a toner accommodated in a developing unit 5, and a toner mage is formed on the surface of the electrophotographic photosensitive member 1. The toner image formed on the surface of the electrophotographic photosensitive member 1 is transferred on a transfer material 7 by a transfer unit 6. A bias voltage having a reverse polarity to the charge retained by the toner is here applied to the transfer unit from a bias power source (not illustrated). When the transfer material 7 is paper, the transfer material 7 is taken out from a paper-feeding unit (not illustrated) and fed between the electrophotographic photosensitive member 1 and the transfer unit 6 in synchronization with the rotation of the electrophotographic photosensitive member 1.

The transfer material 7, on which the toner image is transferred from the electrophotographic photosensitive member 1, is separated from the surface of the electrophotographic photosensitive member 1, conveyed to an image-fixing unit 8, subjected to a fixing treatment of the toner image and discharged as an image forming product (print, copy) outside the electrophotographic apparatus.

The surface of the electrophotographic photosensitive member 1, from which the toner image is transferred to the transfer material 7, is cleaned by removal of an adhering substance such as a toner (transfer residual toner) by a cleaning unit 9. A cleaner-less system has also been recently developed, and the transfer residual toner can also be directly removed by a developing machine or the like. Furthermore, the surface of the electrophotographic photosensitive member 1 is subjected to an antistatic treatment by pre-exposing light 10 from a pre-exposing unit (not illustrated), and thereafter repeatedly used for image formation. Herein, when the charging unit 3 is a contact charging unit using a charging roller or the like, the pre-exposing unit is not necessarily needed.

In the present invention, a plurality of constituent elements among the constituent elements such as the electrophotographic photosensitive member 1, the charging unit 3 and the cleaning unit 9 may be accommodated in a container to be integrally supported to form a process cartridge. The process cartridge can be then configured to be detachably attachable to the main body of the electrophotographic apparatus. For example, at least one selected from the charging unit 3, the developing unit 5 and the cleaning unit 9 is integrally supported together with the electrophotographic photosensitive member 1 to form a cartridge, and the cartridge can be formed into a process cartridge 11 detachably attachable to the main body of the electrophotographic apparatus by using a guide unit such as a rail of the main body of the electrophotographic apparatus.

When the electrophotographic apparatus is a copier or a printer, the image exposing light 4 may be light reflected or transmitted from an original manuscript. Alternatively, the image exposing light 4 may be light radiated by reading of the original manuscript by a sensor for conversion to signals, and scanning of a laser beam, driving of an LED array, driving of a liquid crystal shutter array, or the like performed according to the signals.

The electrophotographic photosensitive member 1 of the present invention can also be widely applied in the electrophotographic application field such as a laser beam printer, a CRT printer, an LED printer, FAX, a liquid crystal printer and laser plate making.

EXAMPLES

Hereinafter, the present invention is described with reference to specific Examples in more detail. "Part(s)" described below means "part(s) by mass". The present invention, however, is not limited thereto. Herein, the thickness of each of the layers of the electrophotographic photosensitive member in each of Examples and Comparative Examples was determined by an eddy current type film thickness meter (Fischerscope manufactured by Fischer Instruments), or determined from the mass per unit area in terms of specific gravity.

Synthesis Example 1

Under a nitrogen flow atmosphere, 5.46 parts of phthalonitrile and 45 parts of α-chloronaphthalene were loaded to a reaction vessel and thereafter heated to a temperature of 30° C., and thereafter the temperature was kept. Next, 3.75 parts of gallium trichloride was loaded thereto at the temperature (30° C.). The moisture value of the mixed liquid in loading was 150 ppm. Thereafter, the temperature was raised to 200° C. Next, under a nitrogen flow atmosphere, the resultant was subjected to a reaction at a temperature of 200° C. for 4.5 hours and thereafter cooled, and when the temperature reached 150° C., the resultant was filtered to provide a product. The resulting product by filtration was dispersed in and washed with N,N-dimethylformamide at a temperature of 140° C. for 2 hours, and thereafter the resultant was filtered. The resulting product by filtration was washed with methanol, and thereafter dried to provide 4.65 parts of a chlorogallium phthalocyanine pigment (yield: 71%).

Synthesis Example 2

The chlorogallium phthalocyanine pigment obtained in Synthesis Example 1 (4.65 parts) was dissolved in 139.5 parts of concentrated sulfuric acid at a temperature of 10° C., the resulting solution was dropped in 620 parts of ice water under stirring, for reprecipitation, and filtered using a filter press. The resulting wet cake (product by filtration) was dispersed in and washed with 2% ammonia water, and thereafter filtered using a filter press. Next, the resulting wet cake (product by filtration) was dispersed in and washed with ion-exchange water, thereafter filtration using a filter press was repeated three times, and thereafter a hydroxygallium phthalocyanine pigment (hydrous hydroxygallium phthalocyanine pigment) having a solid content of 23% was obtained (acid pasting treatment).

Next, 6.6 kg of the resulting hydroxygallium phthalocyanine pigment (hydrous hydroxygallium phthalocyanine pigment) was dried using a Hyper-Dry dryer (product name: HD-06R, frequency (oscillation frequency): 2455 MHz±15 MHz, manufactured by Biocon (Japan) Ltd.) as follows.

The resulting hydroxygallium phthalocyanine pigment was placed on a dedicated circular plastic tray as a mass taken out from the filter press (the thickness of the hydrous cake: 4 cm or less), and far infrared rays were set to OFF and the temperature of the inner wall of the dryer was set to 50° C. Then, when irradiation with a microwave was performed, a vacuum pump and a leak valve were adjusted to adjust the degree of vacuum to 4.0 to 10.0 kPa.

First, in a first step, the hydroxygallium phthalocyanine pigment was irradiated with a microwave of 4.8 kW for 50 minutes, and the microwave was then turned off once and the leak valve was closed once to provide a high vacuum atmosphere of 2 kPa or less. The solid content of the hydroxygallium phthalocyanine pigment here was 88%.

In a second step, the leak valve was adjusted to adjust the degree of vacuum (the pressure in the dryer) to the setting value (4.0 to 10.0 kPa), thereafter the hydroxygallium phthalocyanine pigment was irradiated with a microwave of 1.2 kW for 5 minutes, and the microwave was turned off once and the leak valve was closed once to provide a high vacuum of 2 kPa or less. The second step was repeated one more time (twice in total). The solid content of the hydroxygallium phthalocyanine pigment here was 98%.

Furthermore, in a third step, irradiation with a microwave was performed in the same manner as in the second step except that the microwave in the second step was changed from 1.2 kW to 0.8 kW. The third step was repeated one more time (twice in total).

Furthermore, in a fourth step, the leak valve was adjusted to adjust the degree of vacuum (the pressure in the dryer) to the setting value (4.0 to 10.0 kPa), thereafter the hydroxygallium phthalocyanine pigment was irradiated with a microwave of 0.4 kW for 3 minutes, and the microwave was turned off once and the leak valve was closed once to provide a high vacuum of 2 kPa or less. The fourth step was further repeated seven times (8 times in total).

As described above, 1.52 kg of a hydroxygallium phthalocyanine pigment having a water content of 1% or less was obtained in 3 hours in total.

Example 1-1

Figure 2:
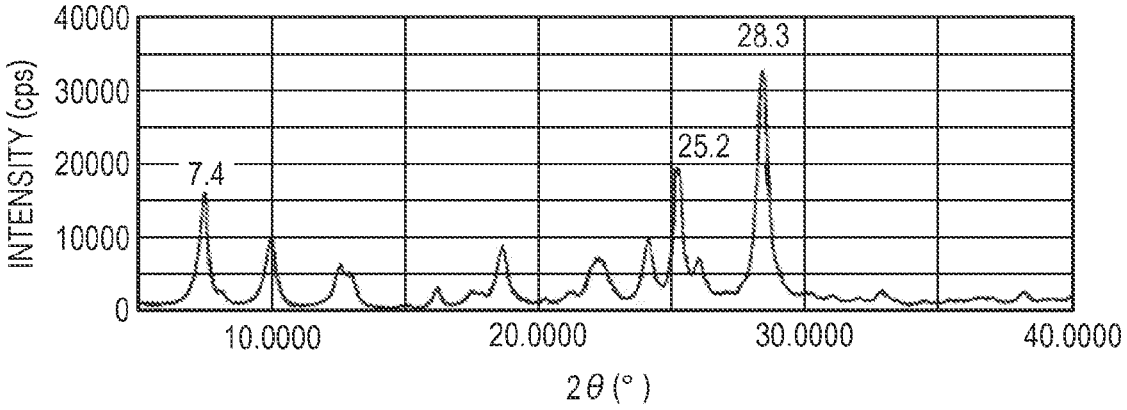
FIG. 2 is a powder X-ray diffraction diagram of a hydroxygallium phthalocyanine crystal obtained in Example 1-1.

The hydroxygallium phthalocyanine obtained in Synthesis Example 2 (0.5 parts) and 10 parts of N,N-dimethylformamide were subjected to a milling treatment by a ball mill together with 20 parts of glass beads having a diameter of 0.8 mm under conditions of room temperature (23° C.) and 120 rpm for 400 hours. A hydroxygallium phthalocyanine crystal was taken out from such a dispersion by using N,N-dimethylformamide, and filtration was conducted and a filter was sufficiently washed with tetrahydrofuran. A product taken out by filtration was dried under vacuum to provide 0.45 parts of a hydroxygallium phthalocyanine crystal. The powder X-ray diffraction diagram of the resulting crystal is illustrated in FIG. 2.

It was confirmed by NMR measurement that the content of N,N-dimethylformamide relative to the hydroxygallium phthalocyanine in the hydroxygallium phthalocyanine crystal obtained in the present Example was 1.4% by mass in terms of the ratio of proton.

Example 1-2

Except that the milling treatment time was changed from 400 hours to 2000 hours in Example 1-1, the same treatment as in Example 1-1 was performed to provide 0.43 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N,N-dimethylformamide relative to the hydroxygallium phthalocyanine in the hydroxygallium phthalocyanine crystal obtained in the present Example was 0.8% by mass in terms of the ratio of proton.

Example 1-3

Except that 10 parts of N,N-dimethylformamide was changed to 10 parts of dimethylsulfoxide and the milling treatment time was changed from 400 hours to 100 hours in Example 1-1, the same treatment as in Example 1-1 was performed to provide 0.40 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of dimethylsulfoxide relative to the hydroxygallium phthalocyanine in the hydroxygallium phthalocyanine crystal obtained in the present Example was 2.0% by mass in terms of the ratio of proton.

Example 1-4

Except that the milling treatment time was changed from 100 hours to 2000 hours in Example 1-3, the same treatment as in Example 1-3 was performed to provide 0.39 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of dimethylsulfoxide relative to the hydroxygallium phthalocyanine in the hydroxygallium phthalocyanine crystal obtained in the present Example was 0.7% by mass in terms of the ratio of proton.

Example 1-5

Except that 10 parts of N,N-dimethylformamide was changed to 10 parts of N-methylformamide and the milling treatment time was changed from 400 hours to 200 hours in Example 1-1, the same treatment was performed as in Example 1-1 to provide 0.45 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-methylformamide relative to the hydroxygallium phthalocyanine in the hydroxygallium phthalocyanine crystal obtained in the present Example was 1.2% by mass in terms of the ratio of proton.

Example 1-6

Except that the milling treatment time was changed from 200 hours to 1000 hours in Example 1-5, the same treatment as in Example 1-5 was performed to provide 0.43 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-methylformamide relative to the hydroxygallium phthalocyanine in the hydroxygallium phthalocyanine crystal obtained in the present Example was 0.5% by mass in terms of the ratio of proton.

Example 1-7

Except that 10 parts of N,N-dimethylformamide was changed to 10 parts of N-propylformamide and the milling treatment time was changed from 400 hours to 300 hours in Example 1-1, the same treatment as in Example 1-1 was performed to provide 0.45 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-propylformamide relative to the hydroxygallium phthalocyanine in the hydroxygallium phthalocyanine crystal obtained in the present Example was 1.6% by mass in terms of the ratio of proton.

Example 1-8

Except that the milling treatment time was changed from 300 hours to 1000 hours in Example 1-7, the same treatment as in Example 1-7 was performed to provide 0.43 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-propylformamide relative to the hydroxygallium phthalocyanine in the hydroxygallium phthalocyanine crystal obtained in the present Example was 0.9% by mass in terms of the ratio of proton.

Example 1-9

Except that 10 parts of N,N-dimethylformamide was changed to 10 parts of N-vinylformamide and the milling treatment time was changed from 400 hours to 200 hours in Example 1-1, the same treatment as in Example 1-1 was performed to provide 0.45 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-vinylformamide relative to the hydroxygallium phthalocyanine in the hydroxygallium phthalocyanine crystal obtained in the present Example was 1.8% by mass in terms of the ratio of proton.

Example 1-10

Except that the milling treatment time was changed from 200 hours to 600 hours in Example 1-9, the same treatment as in Example 1-9 was performed to provide 0.45 parts of a hydroxygallium phthalocyanine crystal. The powder X-ray diffraction of the resulting hydroxygallium phthalocyanine crystal was the same as the powder X-ray diffraction illustrated in FIG. 2.

It was confirmed by NMR measurement that the content of N-vinylformamide relative to the hydroxygallium phthalocyanine in the hydroxygallium phthalocyanine crystal obtained in the present Example was 1.5% by mass in terms of the ratio of proton.

Example 1-11

Except that 10 parts of N,N-dimethylformamide was changed to 10 parts of N-methyl-2-pyrrolidone and the milling treatment time was changed from 400 hours to 800 hours in Example 1-1, the same treatment as in Example 1-1 was performed to provide 0.44 parts of a hydroxygallium phthalocyanine crystal. The powder X-ray diffraction of the resulting hydroxygallium phthalocyanine crystal was the same as the powder X-ray diffraction illustrated in FIG. 2. It was confirmed by NMR measurement that the content of N-methyl-2-pyrrolidone relative to the hydroxygallium phthalocyanine in the hydroxygallium phthalocyanine crystal obtained in the present Example was 1.4% by mass in terms of the ratio of proton.

Example 1-12

The chlorogallium phthalocyanine obtained in Synthesis Example 1 (0.5 parts) was subjected to a dry milling treatment by a ball mill together with 20 parts of glass beads having a diameter of 0.8 mm at room temperature (23° C.) for 40 hours. Ten parts of N,N-dimethylformamide was added thereto and subjected to a wet milling treatment at room temperature (23° C.) for 100 hours.

Figure 3:
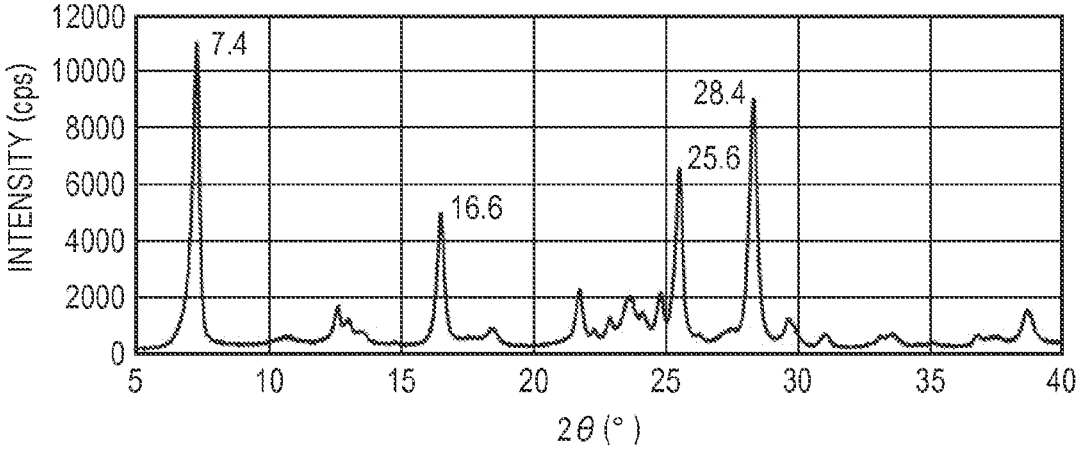
FIG. 3 is a powder X-ray diffraction diagram of a chlorogallium phthalocyanine crystal obtained in Example 1-12.

A gallium phthalocyanine crystal was taken out from the resulting dispersion by using N,N-dimethylformamide, and filtration was conducted and a filter was sufficiently washed with tetrahydrofuran. A product taken out by filtration was dried under vacuum to provide 0.44 parts of a chlorogallium phthalocyanine crystal. The powder X-ray diffraction diagram of the resulting crystal is illustrated in FIG. 3.

It was confirmed by NMR measurement that the content of N,N-dimethylformamide relative to the chlorogallium phthalocyanine in the chlorogallium phthalocyanine crystal obtained in present Example was 1.0% by mass in terms of the ratio of proton.

Example 1-13

Except that 10 parts of N,N-dimethylformamide was changed to 10 parts of N-methylformamide in Example 1-12, the same treatment as in Example 1-12 was performed to provide 0.45 parts of a chlorogallium phthalocyanine crystal. The powder X-ray diffraction of the resulting chlorogallium phthalocyanine crystal was the same as the powder X-ray diffraction illustrated in FIG. 3.

It was confirmed by NMR measurement that the content of N-methylformamide relative to the chlorogallium phthalocyanine in the chlorogallium phthalocyanine crystal obtained in the present Example was 1.5% by mass in terms of the ratio of proton.

Example 1-14

Except that 10 parts of N,N-dimethylformamide was changed to 10 parts of dimethylsulfoxide and the wet milling treatment time was changed from 400 hours to 140 hours in Example 1-1, the same treatment as in Example 1-1 was performed to provide 0.41 parts of a hydroxygallium phthalocyanine crystal. The powder X-ray diffraction of the hydroxygallium phthalocyanine crystal thus obtained was the same as the powder X-ray diffraction illustrated in FIG. 2.

It was confirmed by NMR measurement that the content of dimethylsulfoxide relative to the hydroxygallium phthalocyanine in the hydroxygallium phthalocyanine crystal obtained in present Example was 1.9% by mass in terms of the ratio of proton.

Comparative Example 1-1

Except that the wet milling treatment time was changed from 400 hours to 48 hours in Example 1-1, the same treatment as in Example 1-1 was performed to provide 0.46 parts of a hydroxygallium phthalocyanine crystal.

It was confirmed by NMR measurement that the content of N,N-dimethylformamide relative to the hydroxygallium phthalocyanine in the hydroxygallium phthalocyanine crystal obtained in the present Comparative Example was 2.1% by mass in terms of the ratio of proton.

Comparative Example 1-2

Except that the wet milling treatment time was changed from 100 hours to 48 hours in Example 1-3, the same treatment as in Example 1-3 was performed to provide 0.41 parts of a hydroxygallium phthalocyanine crystal.

It was confirmed by NMR measurement that the content of dimethylsulfoxide relative to the hydroxygallium phthalocyanine in the hydroxygallium phthalocyanine crystal obtained in the present Comparative Example was 2.1% by mass in terms of the ratio of proton.

Comparative Example 1-3

Except that the wet milling treatment time was changed from 800 hours to 48 hours in Example 1-11, the same treatment as in Example 1-11 was performed to provide 0.44 parts of a hydroxygallium phthalocyanine crystal.

It was confirmed by NMR measurement that the content of N-methyl-2-pyrrolidone relative to the hydroxygallium phthalocyanine in the hydroxygallium phthalocyanine crystal obtained in the present Comparative Example was 3.0% by mass in terms of the ratio of proton.

Example 2-1

Sixty parts of a barium sulfate particle covered with tin oxide (product name: Pastolan PC1, produced by Mitsui Mining & Smelting Co., Ltd.), 15 parts of a titanium oxide particle (product name: TITANIX JR, produced by Tayca), 43 parts of a resol type phenol resin (product name: Phenolite J-325, produced by DIC Corporation, solid content: 70% by mass), 0.015 parts of a silicone oil (product name: SH28PA, produced by Dow Corning Toray Silicone Co., Ltd.), 3.6 parts of a silicone resin (product name: Tospearl 120, produced by Toshiba Silicone Co., Ltd.), 50 parts of 2-methoxy-1-propanol and 50 parts of methanol were subjected to a dispersing treatment by a ball mill for hours to thereby prepare a coating liquid for an electro-conductive layer.

An alumina cylinder as the support was dip-coated with the coating liquid for an electro-conductive layer, and the resulting coating film was dried at 140° C. for 30 minutes to thereby form an electro-conductive layer having a thickness of 15 μm.

Next, 10 parts of a copolymerized nylon resin (product name: Amilan CM8000, produced by Toray Industries Inc.) and 30 parts of a methoxymethylated 6 nylon resin (product name: Tresin EF-30T, produced by Teikoku Chemical Industries Co., Ltd.) were dissolved in a mixed solvent of 400 parts of methanol/200 parts of n-butanol to thereby prepare a coating liquid for an undercoat layer.

The electro-conductive layer was dip-coated with the coating liquid for an undercoat layer, and the resulting coating film was dried to thereby form an undercoat layer having a thickness of 0.7 μm.

Next, 10 parts of the hydroxygallium phthalocyanine crystal (charge-generating substance) obtained in Example 1-1, 5 parts of polyvinyl butyral (product name: S-LEC BX-1, produced by Sekisui Chemical Co., Ltd.) and 250 parts of cyclohexanone were loaded in a sand mill using glass beads having a diameter of 1 mm and subjected to a dispersing treatment for 6 hours, and 250 parts of ethyl acetate was added thereto for diluting to thereby prepare a coating liquid for a charge generating layer.

The undercoat layer was dip-coated with the coating liquid for a charge generating layer, and the resulting coating film was dried at 100° C. for 10 minutes to thereby form a charge generating layer having a thickness of 0.22 μm.

Next, 6 parts of a compound (charge transporting material) represented by the following formula (CTM-1), 3 parts of a compound (charge transporting material) represented by the following formula (CTM-2) and 10 parts of a polycarbonate resin represented by exemplary compound (5) were dissolved in 70 parts of tetrahydrofuran and 20 parts of toluene to thereby prepare a coating liquid for a charge transporting layer.

(CTM-1)

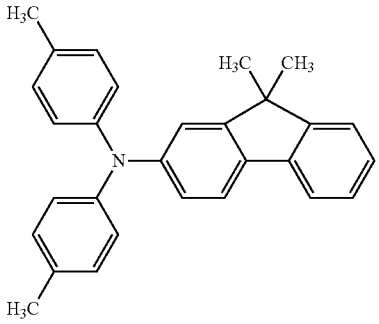

(CTM-2)

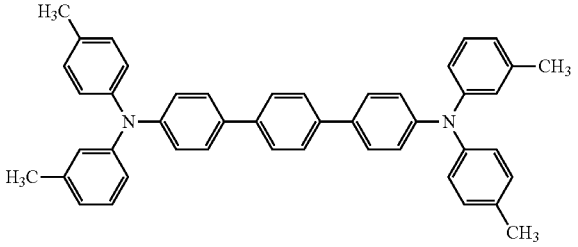

The charge generating layer was dip-coated with the coating liquid for a charge transporting layer, and the resulting coating film was dried at 125° C. for 1 hour to thereby form a charge transporting layer having a thickness of 15.5 μm.

Thus, a cylindrical (drum-shaped) electrophotographic photosensitive member of the present Example was produced.

Example 2-2

Except that, in Example 2-1, the hydroxygallium phthalocyanine crystal obtained in Example 1-1 in preparation of the coating liquid for a charge generating layer was changed to the hydroxygallium crystal obtained in Example 1-2 and furthermore the polycarbonate resin represented in exemplary compound (5) was changed to the polycarbonate resin represented in exemplary compound (1), the same manner as in Example 2-1 was performed to produce an electrophotographic photosensitive member of the present Example.

Example 2-3

Except that, in Example 2-1, the hydroxygallium phthalocyanine crystal obtained in Example 1-1 in preparation of the coating liquid for a charge generating layer was changed to the hydroxygallium phthalocyanine crystal obtained in Example 1-3, the same manner as in Example 2-1 was performed to produce an electrophotographic photosensitive member in the present Example.

Example 2-4

In Example 2-3, the hydroxygallium phthalocyanine crystal obtained in Example 1-1 in preparation of the coating liquid for a charge generating layer was changed to the hydroxygallium phthalocyanine crystal obtained in Example 1-4 and furthermore the polycarbonate resin represented by exemplary compound (5) was changed to the polycarbonate resin represented by exemplary compound (2), the same manner as in Example 2-3 was performed to produce an electrophotographic photosensitive member of the present Example.

Example 2-5

In Example 2-1, the hydroxygallium phthalocyanine crystal obtained in Example 1-1 in preparation of the coating liquid for a charge generating layer was changed to the hydroxygallium phthalocyanine crystal obtained in Example 1-5 and furthermore the polycarbonate resin represented by exemplary compound (5) was changed to the polycarbonate resin represented by exemplary compound (1) and the solvents were changed from tetrahydrofuran (dipole moment: 1.36 D) to o-xylene (dipole moment: 0.5 D) and from toluene (dipole moment: 0.36 D) to dimethoxymethane (dipole moment: 0.91 D), the same manner as in Example 2-1 was performed to produce an electrophotographic photosensitive member of the present Example.

Example 2-6

In Example 2-5, the hydroxygallium phthalocyanine crystal obtained in Example 1-5 in preparation of the coating liquid for a charge generating layer was changed to the hydroxygallium phthalocyanine crystal obtained in Example 1-6 and also the polycarbonate resin represented by exemplary compound (1) in preparation of the coating liquid for a charge transporting layer was changed to the polycarbonate resin represented by exemplary compound (4), the same manner as in Example 2-5 was performed to produce an electrophotographic photosensitive member of the present Example.

Example 2-7

In Example 2-1, the hydroxygallium phthalocyanine crystal obtained in Example 1-1 in preparation of the coating liquid for a charge generating layer was changed to the hydroxygallium phthalocyanine crystal obtained in Example 1-7 and furthermore except that, the polycarbonate resin represented by exemplary compound (5) in preparation of the coating liquid for a charge transporting layer was changed to the polycarbonate resin represented by exemplary compound (3), the same manner as in Example 2-1 was performed to produce an electrophotographic photosensitive member in the present Example.

Example 2-8

In Example 2-5, the hydroxygallium phthalocyanine crystal obtained in Example 1-1 in preparation of the coating liquid for a charge generating layer was changed to the hydroxygallium phthalocyanine crystal obtained in Example 1-8 and furthermore except that, the polycarbonate resin represented by exemplary compound (1) in preparation of the coating liquid for a charge transporting layer was changed to the polycarbonate resin represented by exemplary compound (5), the same manner as in Example 2-5 was performed to produce an electrophotographic photosensitive member in the present Example.

Example 2-9

In Example 2-1, the hydroxygallium phthalocyanine crystal obtained in Example 1-1 in preparation of the coating liquid for a charge generating layer was changed to the hydroxygallium phthalocyanine crystal obtained in Example 1-9 and furthermore except that, the polycarbonate resin represented by exemplary compound (5) in preparation of the coating liquid for a charge transporting layer was changed to the polycarbonate resin represented by exemplary compound (1), the same manner as in Example 2-1 was performed to produce an electrophotographic photosensitive member in the present Example.

Example 2-10

In Example 2-5, the hydroxygallium phthalocyanine crystal obtained in Example 1-1 in preparation of the coating liquid for a charge generating layer was changed to the hydroxygallium phthalocyanine crystal obtained in Example 1-10 and furthermore the amount of the polycarbonate resin represented by exemplary compound (1) in preparation of the coating liquid for a charge transporting layer was changed from 10 parts to 5 parts and 5 parts of the polycarbonate resin represented by exemplary compound (3) was added, the same manner as in Example 2-5 was performed to produce an electrophotographic photosensitive member of the present Example.

Example 2-11

Except that, in Example 2-5, the hydroxygallium phthalocyanine crystal obtained in Example 1-1 in preparation of the coating liquid for a charge generating layer was changed to the hydroxygallium phthalocyanine crystal obtained in Example 1-11, the same manner as in Example 2-5 was performed to produce an electrophotographic photosensitive member in the present Example.

Example 2-12

In Example 2-1, the hydroxygallium phthalocyanine crystal obtained in Example 1-1 in preparation of the coating liquid for a charge generating layer was changed to the chlorogallium phthalocyanine crystal obtained in Example 1-12 and furthermore except that, 1 part of the polycarbonate resin represented by exemplary compound (5) in preparation of the coating liquid for a charge transporting layer was changed to the polycarbonate resin represented by exemplary compound (1), the same manner as in Example 2-1 was performed to produce an electrophotographic photosensitive member in the present Example.

Example 2-13

In Example 2-5, the hydroxygallium phthalocyanine crystal obtained in Example 1-1 in preparation of the coating liquid for a charge generating layer was changed to the chlorogallium phthalocyanine crystal obtained in Example 1-13 and furthermore except that, the polycarbonate resin represented by exemplary compound (1) in preparation of the coating liquid for a charge transporting layer was changed to the polycarbonate resin represented by exemplary compound (5), the same manner as in Example 2-5 was performed to produce an electrophotographic photosensitive member in the present Example.

Example 2-14

Except that, in Example 2-6, the hydroxygallium phthalocyanine crystal obtained in Example 1-1 in preparation of the coating liquid for a charge generating layer was changed to the hydroxygallium phthalocyanine crystal obtained in Example 1-14, the same manner as in Example 2-6 was performed to produce an electrophotographic photosensitive member in the present Example.

Comparative Example 2-1

In Example 2-1, the hydroxygallium phthalocyanine crystal obtained in Example 1-1 in preparation of the coating liquid for a charge generating layer was changed to the hydroxygallium phthalocyanine crystal obtained in Comparative Example 1-1 and furthermore the polycarbonate resin represented by exemplary compound 5 in preparation of the coating liquid for a charge transporting layer was changed to a polycarbonate resin represented by comparative compound 1, the same manner as in Example 2-1 was performed to produce an electrophotographic photosensitive member of the present Comparative Example.

comparative compound 1

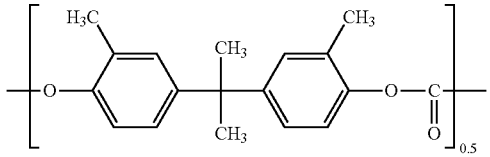

-continued

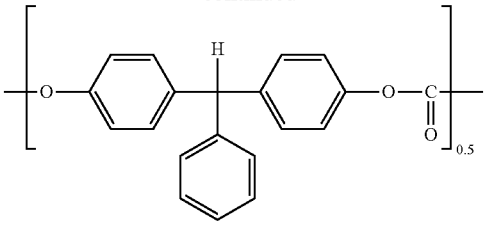

Comparative Example 2-2

In Example 2-1, the hydroxygallium phthalocyanine crystal obtained in Example 1-1 in preparation of the coating liquid for a charge generating layer was changed to the hydroxygallium phthalocyanine crystal obtained in Comparative Example 1-2 and furthermore except that, the polycarbonate resin represented by exemplary compound 5 in preparation of the coating liquid for a charge transporting layer was changed to the polycarbonate resin represented by comparative compound 1, the same manner as in Example 2-1 was performed to produce an electrophotographic photosensitive member in the present Comparative Example.

Comparative Example 2-3

In Example 2-1, the hydroxygallium phthalocyanine crystal obtained in Example 1-1 in preparation of the coating liquid for a charge generating layer was changed to the hydroxygallium phthalocyanine crystal obtained in Comparative Example 1-3 and furthermore except that, the polycarbonate resin represented by exemplary compound 5 in preparation of the coating liquid for a charge transporting layer was changed to the polycarbonate resin represented by comparative compound 1, the same manner as in Example 2-1 was performed to produce an electrophotographic photosensitive member in the present Comparative Example.

Comparative Example 2-4

In Example 2-3, the polycarbonate resin represented by exemplary compound 5 in preparation of the coating liquid for a charge transporting layer was changed to the polycarbonate resin represented by comparative compound 1, the same manner as in Example 2-3 was performed to produce an electrophotographic photosensitive member in the present Comparative Example.

Comparative Example 2-5

In Example 2-3, the hydroxygallium phthalocyanine crystal obtained in Example 1-1 in preparation of the coating liquid for a charge generating layer was changed to the hydroxygallium phthalocyanine crystal obtained in Comparative Example 1-2 and furthermore the polycarbonate resin represented by exemplary compound 5 in preparation of the coating liquid for a charge transporting layer was changed to the polycarbonate resin represented by exemplary compound 7, the same manner as in Example 2-3 was performed to produce an electrophotographic photosensitive member of the present Comparative Example.

Comparative Example 2-6

In Example 2-11, exemplary compound 1 in preparation of the coating liquid for a charge transporting layer was changed to comparative compound 1, the same manner as in Example 2-11 was performed to produce an electrophotographic photosensitive member of the present Comparative Example.

Evaluation of Examples 2-1 to 2-13 and Comparative Examples 2-1 to 2-6

The electrophotographic photosensitive member in each of Examples 2-1 to 2-13 and Comparative Examples 2-1 to 2-6 was evaluated with respect to fogging in an image output after repeated use for 10,000 sheets.

A laser beam printer CP-4525 manufactured by Hewlett-Packard Development Company, L.P. was altered so as to enable to adjust the charging potential (dark portion potential) of the electrophotographic photosensitive member, and was used as an evaluation apparatus with the dark portion potential being set at −450 V. The evaluation was performed under an environment of a temperature of 23° C. and a relative humidity of 50%.

<Fogging Evaluation>

An image of a test chart having a printing rate of 4% was output on A4 size plain paper for 10,000 sheets, thereafter a white solid image was output, and the image rank evaluation with respect to fogging was performed. The resulting image was ranked AA, A, B, C, D, E, F or G. Rank AA means the highest level. Ranks A to D were determined to be at a level where the effect of the present invention was exerted. The evaluation results in Examples and Comparative Examples are shown in Table 1.

TABLE 1

| | Rank after endurance |
|---|---|
| Example 2-1 | C |
| Example 2-2 | B |
| Example 2-3 | D |
| Example 2-4 | B |
| Example 2-5 | A |
| Example 2-6 | AA |
| Example 2-7 | B |
| Example 2-8 | A |
| Example 2-9 | B |
| Example 2-10 | A |
| Example 2-11 | A |
| Example 2-12 | B |
| Example 2-13 | A |
| Example 2-14 | B |
| Comparative Example 2-1 | F |
| Comparative Example 2-2 | G |
| Comparative Example 2-3 | G |
| Comparative Example 2-4 | E |
| Comparative Example 2-5 | F |
| Comparative Example 2-6 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-225221, filed Nov. 5, 2014, and Japanese Patent Application No. 2015-187184, filed Sep. 24, 2015, which are hereby incorporated by reference herein in their entirety.

What is claimed is:

1. An electrophotographic photosensitive member comprising:

a support; and a charge generating layer and a charge transporting layer on the support;

wherein the charge generating layer comprises a gallium phthalocyanine crystal in which an organic compound is contained, wherein the organic compound is at least one compound selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 2.0% by mass or less based on a gallium phthalocyanine in the gallium phthalocyanine crystal, and the charge transporting layer comprises a polycarbonate resin having structural units represented by the following formulae (1) and (2):

(1)

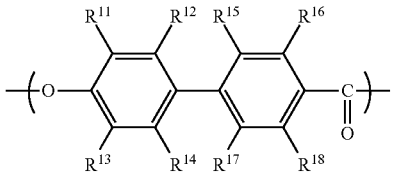

(2)

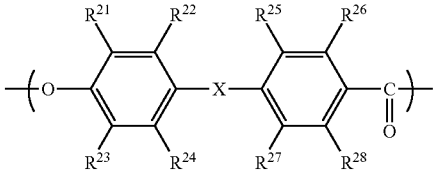

wherein $R^{11}$ to $R^{18}$ in the formula (1) and $R^{21}$ to $R^{28}$ in the formula (2) each independently represent a hydrogen atom, an alkyl group, an aryl group, a halogen atom or an alkoxy group; and X in the formula (2) represents any of

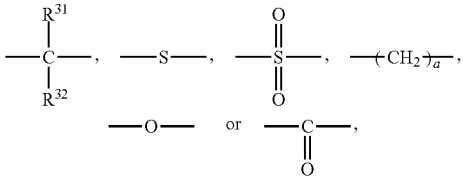

wherein $R^{31}$ and $R^{32}$ each independently represent a hydrogen atom, a halogen atom, a substituted or unsubstituted alkyl group, a substituted or unsubstituted aryl group, a substituted or unsubstituted alkenyl group, or a group required to form a carbocyclic ring or a heterocyclic ring by bonding of $R^{31}$ and $R^{32}$, and a represents an integer of 1 to 20.

2. The electrophotographic photosensitive member according to claim 1, wherein the structural unit represented by the formula (2) is a structural unit represented by any of the following formulae (4) to (7).

(4)

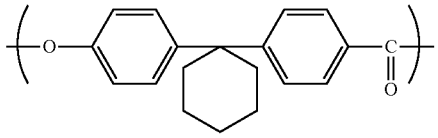

(5)

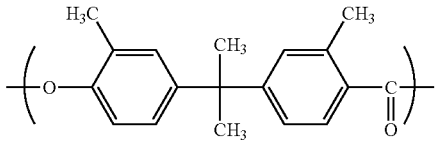

(6)

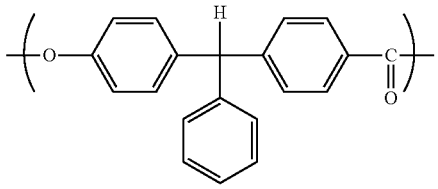

(7)

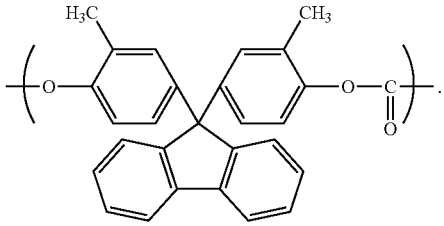

3. The electrophotographic photosensitive member according to claim 1, wherein the content of the organic compound is 0.1% by mass or more and 1.9% by mass or less based on the gallium phthalocyanine.

4. The electrophotographic photosensitive member according to claim 1, wherein the content of the organic compound is 0.3% by mass or more and 1.5% by mass or less based on the gallium phthalocyanine.

5. The electrophotographic photosensitive member according to claim 1, wherein the organic compound is at least one compound selected from the group consisting of N-methylformamide, N-propylformamide and N-vinylformamide.

6. The electrophotographic photosensitive member according to claim 1, wherein the charge transporting layer is formed using a solvent having a dipole moment of 1.0 D or less.

7. The electrophotographic photosensitive member according to claim 6, wherein the solvent having a dipole moment of 1.0 D or less is at least one selected from the group consisting of xylene and dimethoxymethane.

8. The electrophotographic photosensitive member according to claim 1, wherein the gallium phthalocyanine crystal is a hydroxygallium phthalocyanine crystal.

9. The electrophotographic photosensitive member according to claim 1, wherein the gallium phthalocyanine crystal is a chlorogallium phthalocyanine crystal.

10. A process cartridge detachably attachable to a main body of an electrophotographic apparatus, wherein the process cartridge integrally supports:

an electrophotographic photosensitive member, and at least one unit selected from the group consisting of a charging unit, a developing unit and a cleaning unit, wherein the electrophotographic photosensitive member comprises:

a support; and a charge generating layer and a charge transporting layer on the support;

wherein the charge generating layer comprises a gallium phthalocyanine crystal in which an organic compound is contained, wherein the organic compound is at least one compound selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 2.0% by mass or less based on a gallium phthalocyanine in the gallium phthalocyanine crystal, and the charge transporting layer comprises a polycarbonate resin having structural units represented by the following formulae (1) and (2):

(1)

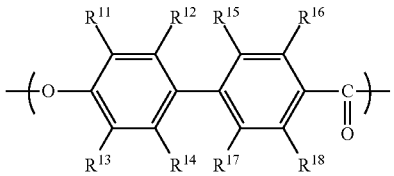

(2)

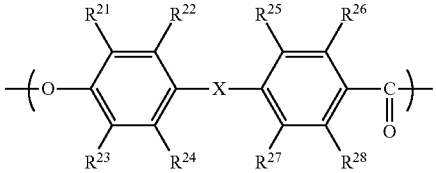

wherein $R^{11}$ to $R^{18}$ in the formula (1) and $R^{21}$ to $R^{28}$ in the formula (2) each independently represent a hydrogen atom, an alkyl group, an aryl group, a halogen atom or an alkoxy group; and X in the formula (2) represents any of

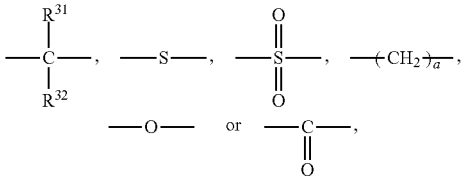

wherein $R^{31}$ and $R^{32}$ each independently represent a hydrogen atom, a halogen atom, a substituted or unsubstituted alkyl group, a substituted or unsubstituted aryl group, a substituted or unsubstituted alkenyl group, or a group required to form a carbocyclic ring or a heterocyclic ring by bonding of $R^{31}$ and $R^{32}$, and a represents an integer of 1 to 20.

11. An electrophotographic apparatus comprising:

an electrophotographic photosensitive member, a charging unit, an exposing unit, a developing unit, and a transferring unit, wherein the electrophotographic photosensitive member comprises:

a support; and a charge generating layer and a charge transporting layer on the support;

wherein the charge generating layer comprises a gallium phthalocyanine crystal in which an organic compound is contained, wherein the organic compound is at least one compound selected from the group consisting of dimethylsulfoxide, N,N-dimethylformamide, N-methylformamide, N-propylformamide, N-vinylformamide and N-methylpyrrolidone, the content of the organic compound is 0.1% by mass or more and 2.0% by mass or less based on a gallium phthalocyanine in the gallium phthalocyanine crystal, and the charge transporting layer comprises a polycarbonate resin having structural units represented by the following formulae (1) and (2):

(1)

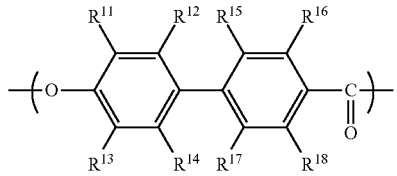

(2)

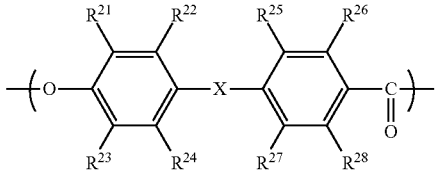

wherein $R^{11}$ to $R^{18}$ in the formula (1) and $R^{21}$ to $R^{28}$ in the formula (2) each independently represent a hydrogen atom, an alkyl group, an aryl group, a halogen atom or an alkoxy group; and X in the formula (2) represents any of

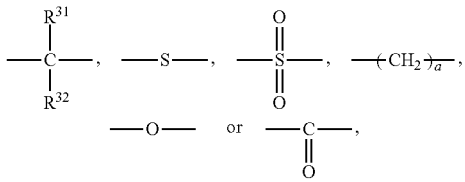

wherein $R^{31}$ and $R^{32}$ each independently represent a hydrogen atom, a halogen atom, a substituted or unsubstituted alkyl group, a substituted or unsubstituted aryl group, a substituted or unsubstituted alkenyl group, or a group required to form a carbocyclic ring or a heterocyclic ring by bonding of $R^{31}$ and $R^{32}$, and a represents an integer of 1 to 20.

* * * * *